United States Patent [19]

DeVinney

[11] 4,131,101

[45] Dec. 26, 1978

[54] ENCLOSURE SPANNING DRAIN FOR ENGINE VALLEY COVERS AND THE LIKE

[75] Inventor: Robert E. DeVinney, Lansing, Mich.

[73] Assignee: General Motors Corporation, Detroit, Mich.

[21] Appl. No.: 830,132

[22] Filed: Sep. 2, 1977

[51] Int. Cl.[2] ..... F02F 7/00

[52] U.S. Cl. ..... 123/195 C; 123/195 R; 123/198 R

[58] Field of Search ..... 123/196 R, 195 C, 195 R, 123/198 R, 198 D, 1 R

[56] References Cited

U.S. PATENT DOCUMENTS

| | | | |
|---|---|---|---|
| 3,396,712 | 8/1968 | Sakraida | 123/195 C |
| 3,422,806 | 1/1969 | Lorean | 123/195 C |
| 3,521,726 | 7/1970 | Freyn | 123/195 C |

*Primary Examiner*—Ronald H. Lazarus
*Attorney, Agent, or Firm*—Robert J. Outland

[57] ABSTRACT

An enclosure spanning circuit for carrying fluids through opposed nonparallel walls of an enclosure used in a preferred embodiment to drain the open valley cover and manifold member of a V-type automotive diesel engine through a drain tube extending through walls of the valley cover and engine block and the crankcase enclosure and having sealing means at the associated wall openings to prevent leakage of the drained fluids into or crankcase vapors out of the engine crankcase.

5 Claims, 4 Drawing Figures

ENCLOSURE SPANNING DRAIN FOR ENGINE VALLEY COVERS AND THE LIKE

SPECIFICATION

This invention relates to fluid conduits and, in a particular embodiment, to a valley cover drain for an internal combustion engine wherein a tubular conduit is sealing mounted in the valley cover and engine block walls spanning the crankcase enclosure to drain liquids from the valley cover while preventing their leakage into the crankcase or the escape of vapors from the crankcase.

In a V-type automotive diesel engine having the general arrangement shown in the co-pending United States Patent Application Serial No. 710,923, now U.S. Pat. No. 4,054,108 filed August 2, 1976 in the name of Lloyd T. Gill and assigned to the assignee of the present invention, there is provided a unitary air inlet manifold and valley cover member having a central well or depressed valley portion between the cylinder banks and heads within which the engine fuel injection pump is mounted and over which the engine air cleaner and air inlet crossover extend. To provide the disclosed compact arrangement, the level of the valley cover is depressed to a point below the upper edges of the surrounding walls of the engine block. Thus, when the engine is installed in a vehicle, even with the usual downward slope to the rear of the engine, the valley cover forms an open well in which liquids such as splashed or spilled water, engine coolant, lubricating oil and fuel can collect. To prevent significant collection of such fluids, suitable means for draining the engine valley cover well are required.

The present invention provides a practical and inexpensive drain arrangement for the diesel engine valley cover described above, which arrangement may be also used for other purposes wherein a sealed enclosure-spanning drain conduit is required. In the preferred application, the drain arrangement extends between the opposed nonparallel walls of the valley cover and engine block, utilizing a molded nylon drain tube member which seals with sharp edged deformable sealing rings in a cylindrical opening on the engine block and with a conically shaped head portion against an annular seat of the valley cover wall. This seat is generally aligned with, but formed at an angle to, the axis of the conduit member and its associated cylindrical opening in the engine block wall. An angled lever clamp member fixed in the bottom wall of the valley cover engages the angled head of the conduit member to fix it in position and urge it laterally into sealing engagement with its seat.

These and other features of the invention will be more fully understood from the following description of a preferred embodiment taken together with the accompanying drawing in which FIG. 1 is a fragmentary cross-sectional view through part of the rear portion of a diesel engine showing valley cover drain means according to the invention;

Figure 1:
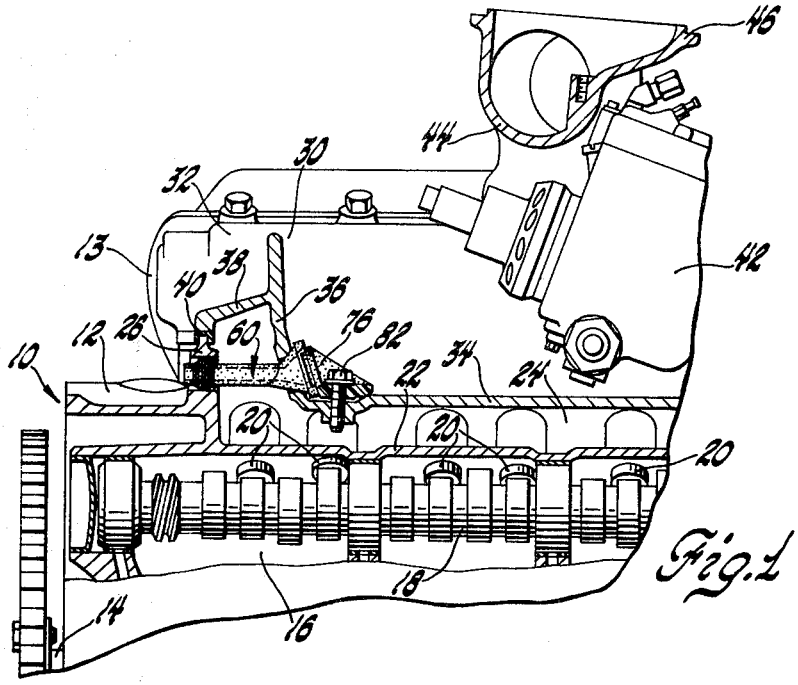
Figure 3:
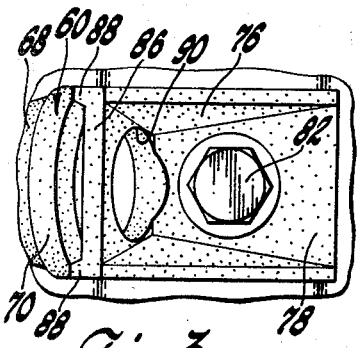
FIG. 3 is a plan view of the clamp and tube installation as seen from the plane of the line 3—3 of FIG. 2.
Figure 2:
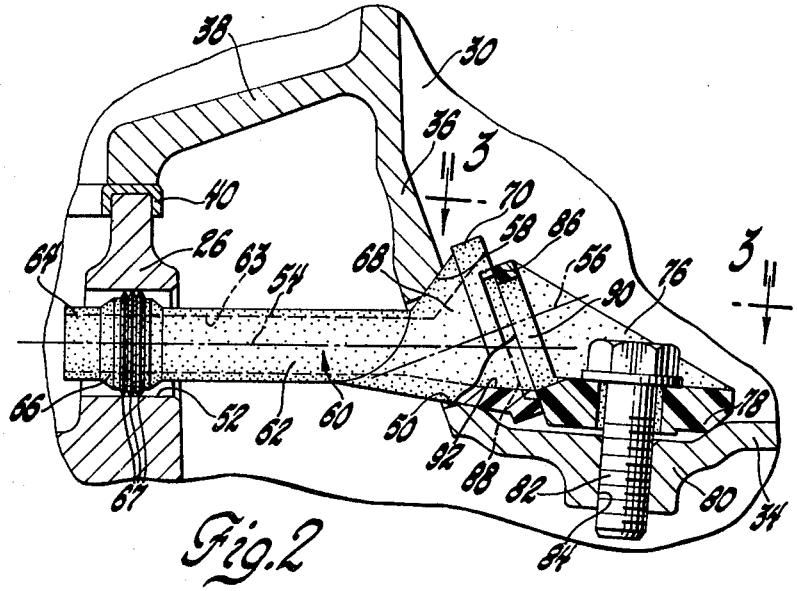
FIG. 2 is an enlarged view of a part of FIG. 1 partially broken away to show details of the drain tube and clamp arrangement.
Figure 4:
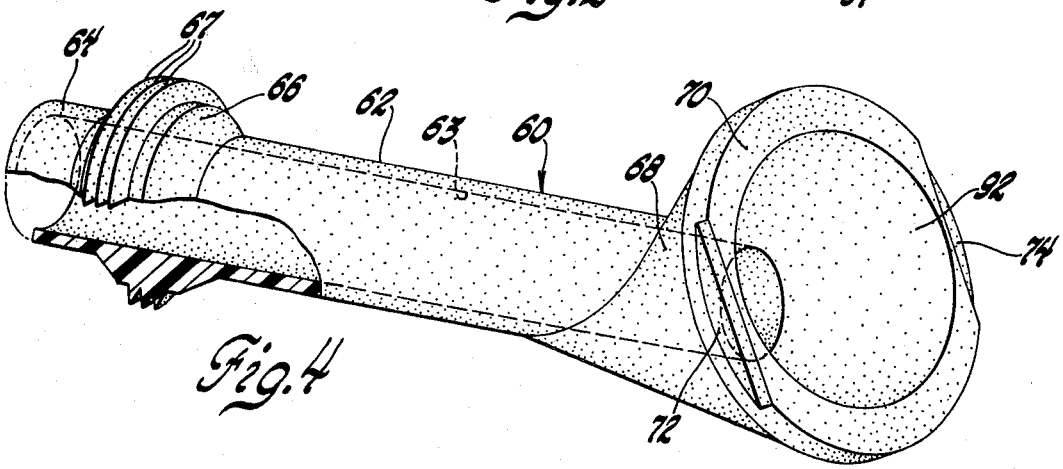
FIG. 4 is a pictorial view of the drain tube member partially broken away to show certain portions of its construction.

Referring now to the drawing in detail, numeral 10 generally indicates a V-8 prechamber type diesel engine of the general type disclosed in the previously mentioned United States Patent Application Serial No. 710,923. Engine 10 includes an engine block 12 defining a pair of angularly disposed cylinder banks mounting cylinder heads 13 and having cylinders with reciprocable pistons therein connected in conventional manner with a crankshaft 14 supported within an enclosed portion of the cylinder block known as the crankcase 16. Also supported within the enclosed crankcase portion of the block is a camshaft 18 which is conventionally driven from the crankshaft through means not shown and in turn actuates valve lifters 20 that are connected with valves controlling ports leading to the various engine cylinders.

The valve lifters are supported in a lifter gallery formed integrally with a wall 22 that extends over the camshaft and connects with the adjacent cylinder banks to form a valley that roughly defines the upper reaches of the crankcase. Wall 22 also defines in part a valley chamber 24 extending above and connected with the crankcase through means, not shown, that permit lubricating oil draining from the upper ends of the cylinder banks and their associated valve gear to return to the crankcase below. One end of the valley chamber 24 is defined by an end wall 26 which forms a part of the engine block, extending upwardly from the crankcase enclosure and laterally between the cylinder banks.

Above the cylinder banks, cylinder heads and valley chamber 24, there extends an integral inlet air manifold and cover member 30. Member 30 incorporates a pair of longitudinally extending air manifold defining portions 32, only one of which is shown. Manifold portions 32 are interconnected laterally by wall portions including a depressed lower wall 34, an end wall 36 connecting with and angled upwardly from the lower wall 34, and a longitudinally extending support wall 38 which seats upon a seal member 40 disposed along the top of the block end wall 26. Walls 34, 36 and 38 extend over the valley chamber 24 and together with the other portions of the manifold and cover member 30 provide a closure for the open top of the valley chamber 24, thus sealing the enclosed chamber 24 against the ingress of foreign fluids which might dilute the engine lubricating oil within the chamber and also the escape of crankcase vapors from the chamber to the engine exterior.

Walls 34 and 36 also define a longitudinally extending well having its bottom substantially below the top of the block wall 26 and providing an open space for the mounting of a fuel injection pump 42. The pump is driven from the engine camshaft through means not shown and is connected in conventional fashion with fuel injectors at each of the cylinders through high pressure fuel lines which have been omitted from the drawing for clarity of the remaining portions thereof. Above the injection pump 42 is an air inlet crossover 44, supported by the air inlet manifold portions 32 and is provided with an air cleaner mounting flange 46 on which an engine air cleaner may be supported to provide clean air to the crossover for transmission through internal passages to the individual air manifold portion and distribution to the cylinders of each cylinder bank.

The arrangement so far described is essentially that of engines of the type disclosed in the previously mentioned United States Patent Application Serial No. 710,923. It is apparent on observation that the open well defined by walls 34 and 36 of the manifold and cover member 30 provides a receptacle in which liquids may collect during the operation or maintenance of the engine or a vehicle in which it is mounted. Such liquids might for example include water from the atmosphere or splashed upwardly from the ground, engine coolant, engine lubricating oil, diesel fuel or other liquids which may through normal or abnormal conditions be dispensed or spilled over the open area. It is, of course, desirable that such collected liquids be drained out of the cover defined well which, as previously mentioned, extends below the level of the top of the engine block wall 26 at the end of the valley area.

The present invention provides novel means for draining the valley cover well which combine the features of ease and low cost of manufacture, simplicity of installation and positive sealing of openings communicating with the valley chamber enclosure. The drain provisions include first and second openings 50, 52 extending respectively through the opposed walls 36 and 26 of the valley cover and engine block. Opening 52 is cylindrical and extends generally at right angles to wall 26 on an axis 54 which also passes through the approximate center of opening 50. However, the portion of wall 36 through which opening 50 extends is slanted outwardly from the vertical so that it is nonparallel with wall 26 in order to provide for the relatively easy machining of opening 50 on an axis 56 essentially perpendicular to that portion of the wall 36. Axis 56 thus slants downwardly in relation to axis 54 so that both openings 50 and 52 lie on axis 54, but the openings are not coaxial. Opening 50 has a conically shaped portion which forms an outwardly facing annular seat 58 around the opening in the wall 36.

The drain system further includes a drain tube member 60 having a tubular body 62 which extends into and through openings 50 and 52 defining internally a drain passage 63 for liquids to pass. On one end the tube member includes a reduced diameter portion 64 for guiding the end of the tube into the opening 52. Next to portion 64 is an enlarged sealing portion 66 having a plurality of annular sharp edged teeth 67 having diameters as formed slightly larger than the diameter of opening 52 so that the edges of the teeth deform upon installation and provide a close fitting seal between the exterior of the drain tube member and the cylindrical opening 52.

On its other end, drain tube member 60 is provided with a general conical head portion 68 centered on axis 56 and arranged to seat on the conically shaped annular seat 58 of the wall 36 to seal the joint against leakage. The conical head terminates in a flange 70 which includes parallel flats 72, 74 formed along opposite faces of the flange for receiving a securing device.

The drain tube member 60 is forced into and held in positive sealing engagement with the seat 58 by a lever clamp 76 having a fulcrum end 78 that is retained against the edge of a recessed portion 80 of the valley cover lower wall 34 by a bolt 82 threadably retained in a threaded opening 84 in the portion 80. Opposite the fulcrum end 78 the lever clamp has an angled holding portion 86 which engages the outer surface of the drain tube flange 70 and, upon tightening of the clamp, urges the tube laterally into engagement with the conical seat 58. At its edges, the holding portion 86 includes projecting ribs 88 which register with and engage the flats 72, 74 of the drain tube flange 70 to positively locate and position the tube in its installed position. The clamp holding portion 86 is also provided with an opening 90 which connects with a conical recess 92 in the head portion of the drain tube member leading to the passage within the tubular body.

When installed as described, the clamp and drain tube member provide a sealed conduit for draining liquids from the interior of the valley cover well through the cover end wall 36, the intermediate portions of the valley chamber enclosure 24 and the block end wall 26 to the exterior of the engine. Positive sealing of the openings 50, 52 prevents either the leakage of drainage liquids into the valley chamber and crankcase or the escape of crankcase vapors from the valley chamber to the engine exterior through the wall openings. While the drain tube member and clamp may be made of any suitable materials, it is presently preferred to mold these components out of a relatively rigid but deformable material such as nylon. It is, of course, intended that any suitable substitute material in the metal or plastic family could also be used for this purpose.

While the invention has been described by reference to a preferred embodiment chosen for purposes of illustration, it should be understood that numerous changes could be made within the scope of the inventive concepts disclosed, and it is accordingly intended that the invention not be limited except by reference to the appended claims.

What is claimed is:

1. The combination in a combustion engine of wall means defining a cavity for lubricated mechanism and adapted to contain a lubricant, said wall means having upwardly extending sides and an open top, a cover member mounted on said wall means and closing said open top to retain fluids within the cavity and prevent dilution of the lubricant with foreign substances, said cover member having downwardly sloping wall portions defining an open valley extending within the upper part of said cavity, and the improvement comprising:

a first drain opening through said cover member between said valley and lubricant cavity, said opening having an axis and forming an annular seat facing said valley, a second drain opening through said wall means between said lubricant cavity and the exterior of said wall means, said second opening comprising a cylindrical bore having an axis aligned with said first opening but at an angle to said first axis, a drain tube extending into and between said drain openings generally along the axis of said second opening, said drain tube including an annular sealing portion on its exterior which sealingly engages the cylindrical bore of said second opening and an enlarged head portion in said first opening, said head portion being centered on an axis substantially coincident with the axis of said first opening and sealingly engaging said annular seat, said drain tube having an open passage therethrough connecting said cover valley with the exterior of said wall means to drain said valley, and retaining means holding said drain tube in position such that the enlarged head and annular sealing portions, respectively prevent leakage of fluids into or out of said cavity through said first and second openings.

2. The combination in a combustion engine of opposed nonparallel walls defining an enclosure and conduit means for carrying fluids between and through said opposed nonparallel walls of the enclosure while sealing against leakage into the enclosure, said conduit means comprising:

a first opening through one of said walls, said opening having an axis and forming an annular seat facing outwardly of said enclosure a second opening through the other of said walls and comprising a cylindrical bore having an axis aligned with said first opening but at an angle with said first axis, a tube member extending through said enclosure into and between said openings generally along the axis of said second opening, said tube member having an annular sealing portion on its exterior which sealingly engages the cylindrical bore of said second opening, and an enlarged head portion in said first opening and substantially coaxial therewith, said head portion sealingly engaging said annular seat, said tube member having an open passage therethrough connecting the outer sides of said opposed enclosure walls, a lever clamp member adjacent said tube head, said clamp member having a holding portion engaging the outer end of said tube head, a fulcrum portion spaced from said holding portion and engaging said one wall and adjustable securing means in said one wall and engaging the clamp member intermediate the fulcrum and holding portions to apply a holding force thereto and thereby to the tube member to maintain its sealing engagement with the annular seat, said clamp member holding portions being inclined relative to said securing means such that application of the securing means urges the tube member laterally, forcing the annular sealing portion into the second opening and the enlarged head portion against the seat of the first opening to positively engage and seal the enclosure against leakage through said openings.

3. The combination of claim 2 wherein said tube member further comprises a reduced diameter end outward of the annular sealing portion to guide said sealing portion into the cylindrical second opening during installation of the tube, said annular sealing portion being smaller than said first opening to permit installation of the tube through said first opening.

4. The combination of claim 2 wherein said tube member is formed of a relatively rigid but deformable material, said annular sealing portion being formed as a plurality of sharp edged annular teeth integral with said tube member.

5. The combination of claim 4 wherein said tube member is formed of nylon.

* * * * *